US012185776B2

(12) United States Patent
Beraznik

(10) Patent No.: US 12,185,776 B2
(45) **Date of Patent: *Jan. 7, 2025**

(54) EXPOSED EDGE STITCHED BALLGLOVE

(71) Applicant: Jeffrey Beraznik, Phoenix, AZ (US)

(72) Inventor: Jeffrey Beraznik, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/112,340

(22) Filed: Feb. 21, 2023

(65) Prior Publication Data

US 2023/0189905 A1 Jun. 22, 2023

Related U.S. Application Data

(63) Continuation of application No. 16/902,196, filed on Jun. 15, 2020, now Pat. No. 11,583,015, which is a continuation of application No. 29/694,835, filed on Jun. 13, 2019, now Pat. No. Des. 925,835.

(51) Int. Cl.
*A63B 71/14* (2006.01)
*A41D 19/00* (2006.01)

(52) U.S. Cl.
CPC ..... *A41D 19/00* (2013.01); *A63B 71/143* (2013.01)

(58) Field of Classification Search
CPC ..... A41D 19/00; A63B 71/143
See application file for complete search history.

(56) References Cited

U.S. PATENT DOCUMENTS

| | | | | |
|---|---|---|---|---|
| 2,722,007 | A | 11/1955 | Tompkins | |
| D925,835 | S | 7/2021 | Beraznik | |
| 11,583,015 | B1 | 2/2023 | Beraznik | |
| 2008/0060105 | A1 | 3/2008 | Lin et al. | |
| 2013/0167281 | A1* | 7/2013 | Jennings | B29C 35/002 156/196 |
| 2013/0247272 | A1 | 9/2013 | Reed et al. | |
| 2021/0023436 | A1 | 1/2021 | Aoki | |

* cited by examiner

*Primary Examiner* — Tajash D Patel
(74) *Attorney, Agent, or Firm* — Bycer & Marion, PLC; Matthew L. Bycer

(57) ABSTRACT

A ball glove engineered with exposed edge stitching, as opposed to turned leather, whereby the front (palm) and back are joined with one another in the same orientation as they are die cut. The resulting mating of front and back without welting exposes the edge of the leather (or other material) constituting the ball glove with joint lines on the back of the finger(s). Without turning the ball glove, other improvements may be seen such as the use of painted edge, exotic material types, and hard embellishments.

25 Claims, 11 Drawing Sheets

EXPOSED EDGE STITCHED BALLGLOVE

CLAIM OF PRIORITY

The present continuation application includes subject matter disclosed in and claims priority to U.S. patent application Ser. No. 16/902,196, filed Jun. 15, 2020, entitled "Exposed Edge Stitched Ballglove" (now U.S. Pat. No. 11,583,015, issued Feb. 21, 2023); and to design patent application of the same name, filed Jun. 13, 2019, assigned Ser. No. 29/694,835 (now U.S. Design Pat. No. D925,835), and provisional application of the same name, filed Jun. 13, 2019, assigned Ser. No. 62/861,062, all incorporated herein by reference, describing inventions made by the present inventor.

BACKGROUND OF THE INVENTION

1. Field of the Invention

The present invention relates to the art of baseball gloves, and more specifically to a design and manufacture of unturned baseball gloves with exposed edges.

2. Description of Related Prior Art

Baseball gloves are a labor-intensive product calling for a large amount of individual attention. Differences among gloves vary from the thickness of the heel to the design of the web to the deepness of the palm. Outfielders tend to prefer large gloves with deep palms, to make catching fly balls easier. Infielders generally like smaller gloves into which they can reach easily to grip and throw the ball to another player. Most outfielders will break a glove in vertically; infielders tend to prefer gloves broken in horizontally.

Improvements in the design of the glove and the efficiency and protection it offers a ball player are ongoing. Small plastic reinforcements may be used at the base of the small finger and the thumb, and some nylon thread, otherwise a glove is made totally of tanned and cured leather, usually from cattle. Generally, cowhides are the predominant material in use today. Sometimes leather may be sourced from kangaroo hide from Australia, and often in combination with leather from cattle. Kangaroo hide is somewhat softer than cowhide or cattle leather, and the glove can be used after a shorter breaking-in period than usual.

Various synthetic materials have been tested for baseball gloves, but so far none have demonstrated the resilience, and feel that leather has, and no replacement for leather is on the immediate horizon.

The first step in baseball glove manufacture involves die-cutting the leather into four sections: shell, lining, pad, and webbing. Various parts of the glove are cut (typically in dies) and sewn together with a long string (or lace) of rawhide leather. A front and back shell piece are often used. Lettering, such as foil tape (e.g. identifying the manufacturer) is burned into the leather with a brass stamping die.

As is known in the art, the shell of the glove is sewn together while inside-out. It is then turned right-side-out. Lining is then inserted. Before being reversed (or turned as is known in the art), the shell is mulled or steamed. The lacing around the edges of a glove is usually one piece or string of leather. The lacing begins at the thumb or lithe finger and holds the entire shell of the glove together. The turned shell is put on a device known as a hot hand, which is includes four (or five) fingers in a hand-shaped metallic form. Heat from the hot hand helps the shell form to its correct size. At this point, the hot hand also assures that all the openings for the fingers (finger stalls) are open correctly. In order to accommodate and reinforce the edge stitching welting (a thin strip of material) is often placed along the edges between the shells (front and back). Welting reinforces the joint and allows the glove to be turned without losing strength at the edge seam. Additionally, after the glove is turned, piping may be used to cover the inverted turned recess.

A pad may be inserted into the heel of a glove. Better gloves have two-part pads that make it easier for the glove to flex in the correct direction when squeezed. The padding in a glove is made of two layers of leather, often hand-stitched together. Catchers' mitts, which need a thicker palm than other gloves, are made with five layers of leather padding. Plastic reinforcements may also be inserted at the thumb and toe (little finger) sections of the glove. These devices provide added support for the glove and protect the player's fingers from being bent backwards accidentally.

Before completing the lacing, the web is fabricated out of several pieces of leather. The web can consist of anywhere from two to six pieces of leather, depending on the type of web desired. The lacing around the edges of a glove is usually one piece of rawhide string that might be as much as one hundred inches long. The lacing begins at the thumb or little finger and holds the entire glove together. The final lacing operation is at the web section. Some non-leather stitching is needed for the individual parts—the web, for instance, is usually stitched together with nylon thread. The strap across the back of the hand of a glove used to be lined with shearling (sheepskin); a synthetic fabric or felt material is more commonly used today. The palm and back are sewn together first, and then joined together with the other pieces with rawhide lacing.

As is currently predominant, the final step is called a lay off operation; the glove is again placed on a hot hand to adjust any shaping problems and to make sure that the openings for the fingers (finger stalls).

Baseball glove design has not changed much in recent decades. Previous developments included such things as holding the fingers of the glove together with lacing, changes in the design of the pocket and the heel of the glove, and redesigning the catcher's glove so that a catcher can handle a ball with one hand, like other fielders. Earlier attempts at improving the functional design included a six-fingered glove that could be used both at first base and at other infield positions. More recent design developments have focused on how the glove is used at position. Catchers' mitts, for example, have been outfitted with bright, fluorescent edging to make a better target for a pitcher. Others have introduced casual mitts as black gloves with a white palm so that the glove will be a better target for one player throwing a ball to another.

As such the development of the ball glove has not progressed to improve and speed up manufacture, reduce costs, and allow experimentation with new materials and new functionality. The requirements of turning have made the manufacture of ball gloves tedious, effort and skill intensive, and limit the materials available for use.

It is therefore a primary object of the present invention to provide a ball glove that is more easily manufactured without turning.

It is another object of the present invention to provide a method of manufacturing a ball glove without turning.

These and other objects of the present invention will become apparent to those skilled in the art as the description thereof proceeds.

SUMMARY OF THE INVENTION

The present invention is directed to an exposed edge stitched ball glove. The ball glove is made of an outer shell. The outer shell includes the palm or front surface sheet and a back surface that may be made of multiple pieces. The palm and back join to form finger portions, a thumb portion, and a palm portion, with a webbing set between the pointer/index finger and thumb. The outer shell has an opening below (and behind) the palm portion created by an unjoined region of said front surface and said back surface of the shell. The outer shell front surface and back surface are joined, while the exterior surface of each of the front and back surface exposed. No turning is required. The interior side of the palm meets the interior side of the backing (pieces) and lay flat against one another along the seam (outside edge). Thus the material (e.g. leather) lays flat against one another to form shell. Exterior side of each of the palm and rear/back pieces remain exposed and are not bent in to form seams. Fingers and other three-dimensional forms are made by use of design die cuts that can be slightly bent to provide volumetric space within glove, but do not require complete bending, as is known in the art of turning. Stitching is placed around edges of the joined front and back surface pieces. The edges of the palm and back pieces are exposed on an exterior surface of the ball glove, and may be painted or covered with an acrylic or other type of treatment. Hard embellishments may be set on the exterior surface of at least one of said front surface and said back surface, preferably the back surface, that is then joined with the opposing side with edges exposed. The palm may be made of an exotic organic material derived from a reptile and/or fish, such as an alligator or stingray.

The present invention also includes a method of manufacturing a ball glove. Pieces for the shell and liner are die-cut as simple flat pieces in a shape or arrangement predetermined to make the ball glove. Flat pieces may be hot stamped or otherwise met with indicia. The shell (palm and rear pieces) are stitched together to form a three-dimensional shell whereby the thumb and pinky oriented towards one another with the pocket recessed. The liner pieces are also stitched to together and then inserted into the shell. The liner is secured with an adhesive, and then bound to one another. Jelly or tack may be set between the palm and palm liner. Top fingers and webbing may be laced together. Edges between the palm piece and back of the shell are left exposed in edges and joints. The edges and/or joints may be painted or coated with an acrylic or other material as is known in the art to protect the exposed untanned leather cross-section and/or provide indicia.

BRIEF DESCRIPTION OF THE DRAWINGS

The present invention will be described with greater specificity and clarity with reference to the following drawings, in which.

DETAILED DESCRIPTION OF THE PREFERRED EMBODIMENTS

Figure 1:
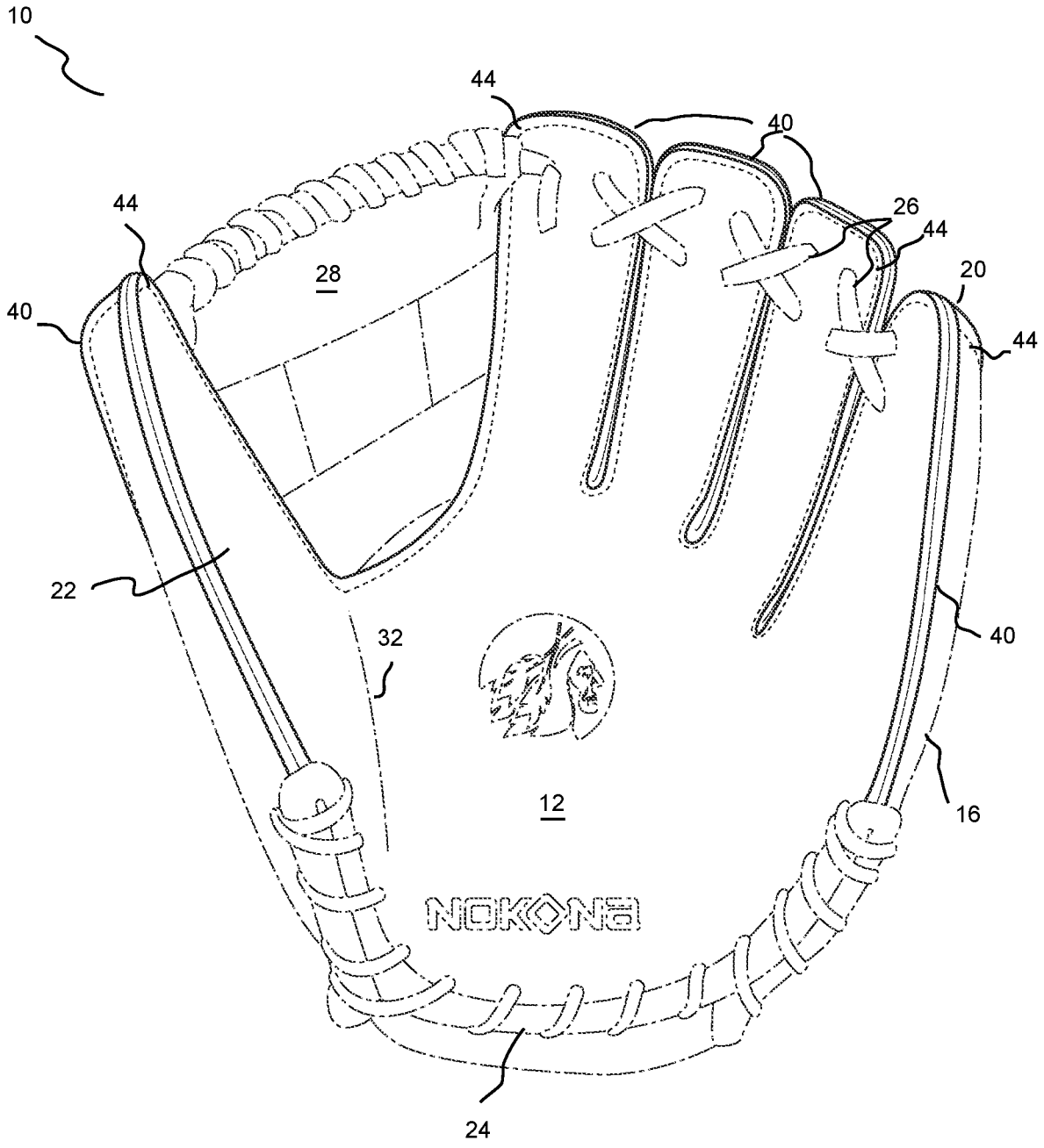
FIG. 1 illustrates a front view of a glove embodiment of the present invention.
Figure 2:
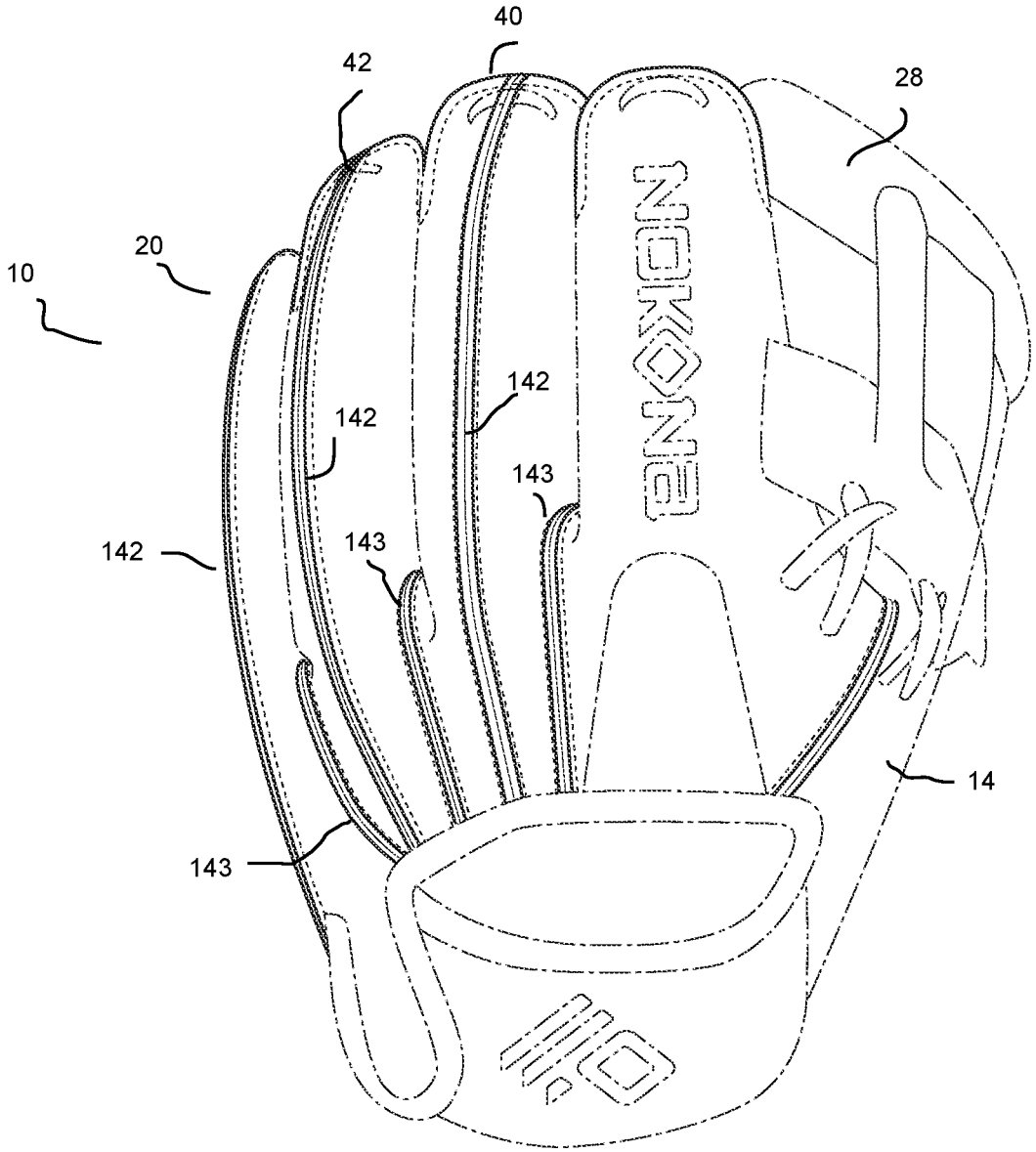
FIG. 2 illustrates a back view of a glove embodiment of the present invention.
Figure 3:
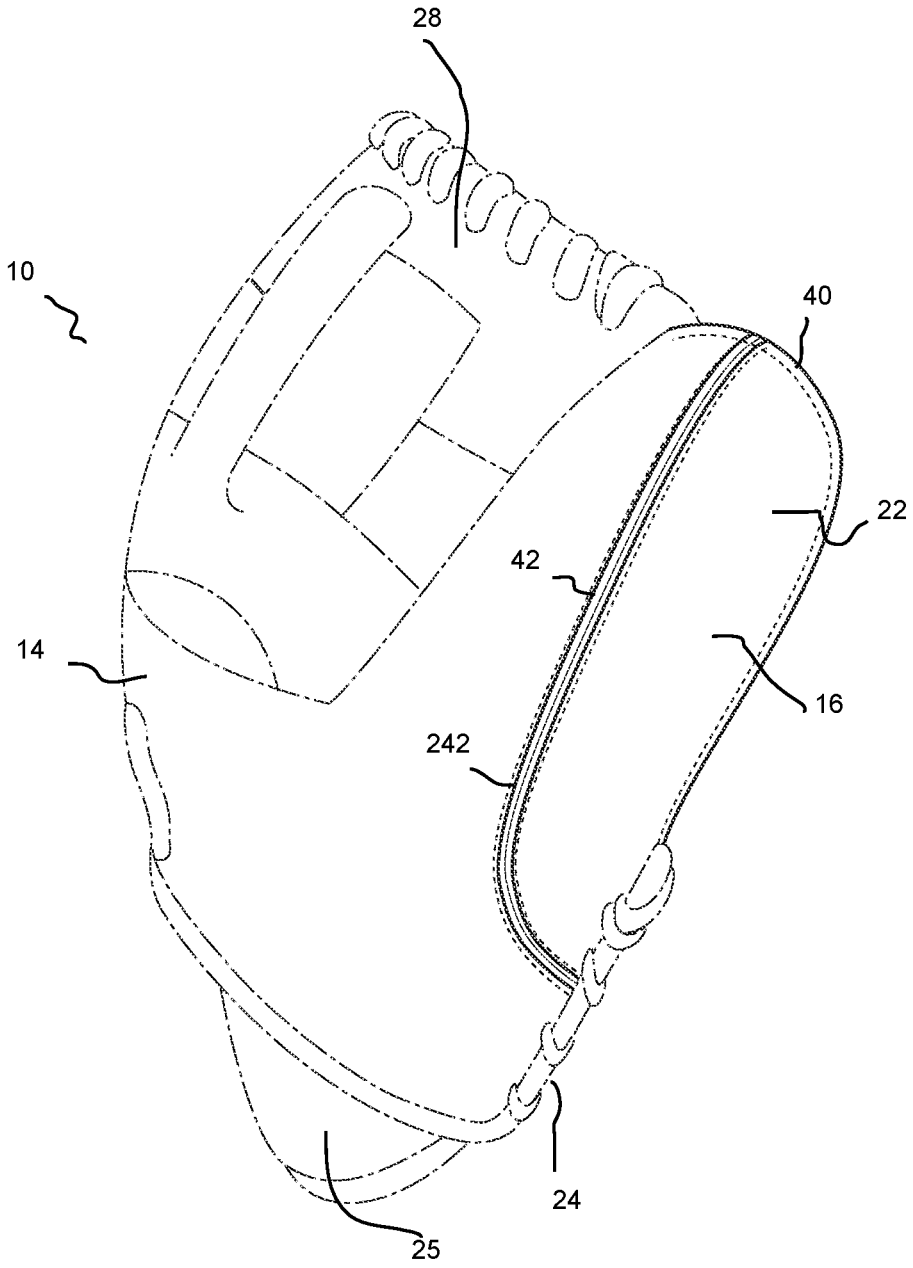
FIG. 3 illustrates a thumb-side view of a glove embodiment of the present invention.
Figure 4:
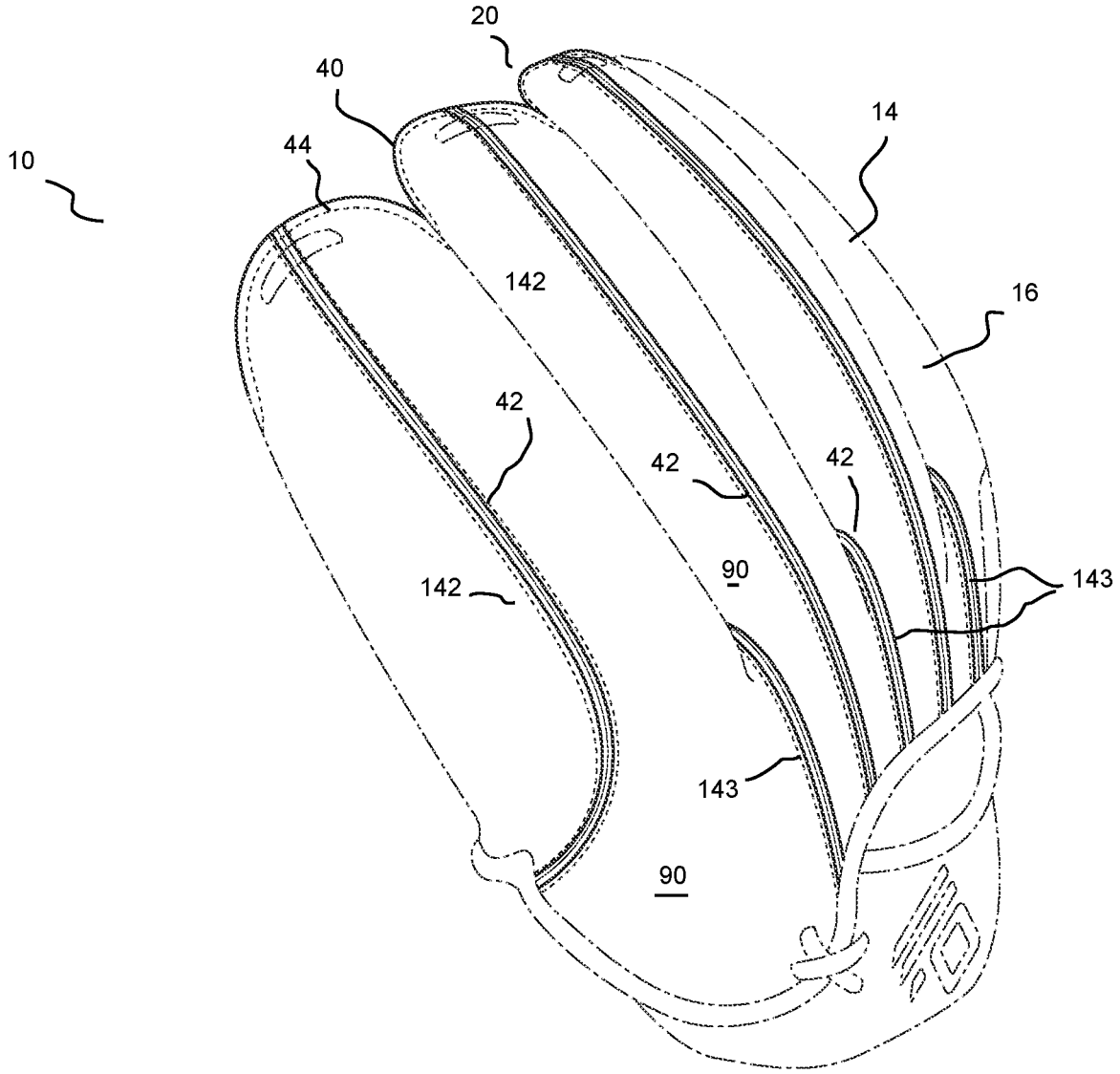
FIG. 4 illustrates a toe-side view of a glove embodiment of the present invention.
Figure 5:
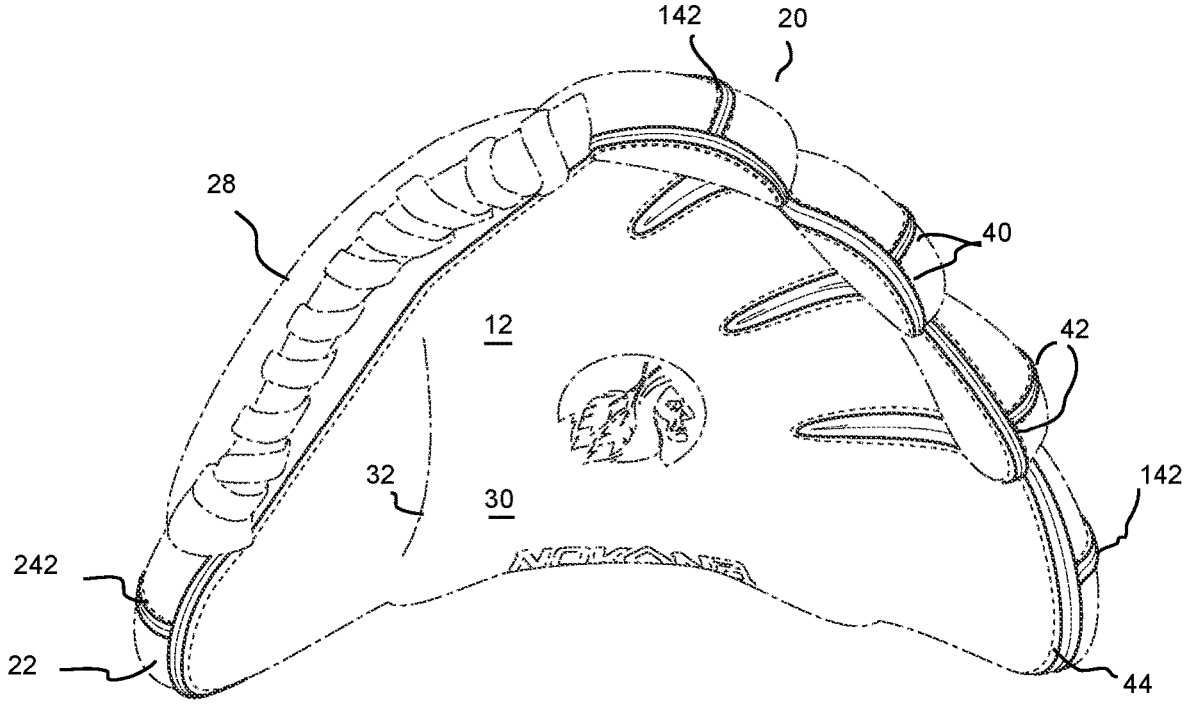
FIG. 5 illustrates a top view of a glove embodiment of the present invention.
Figure 6:
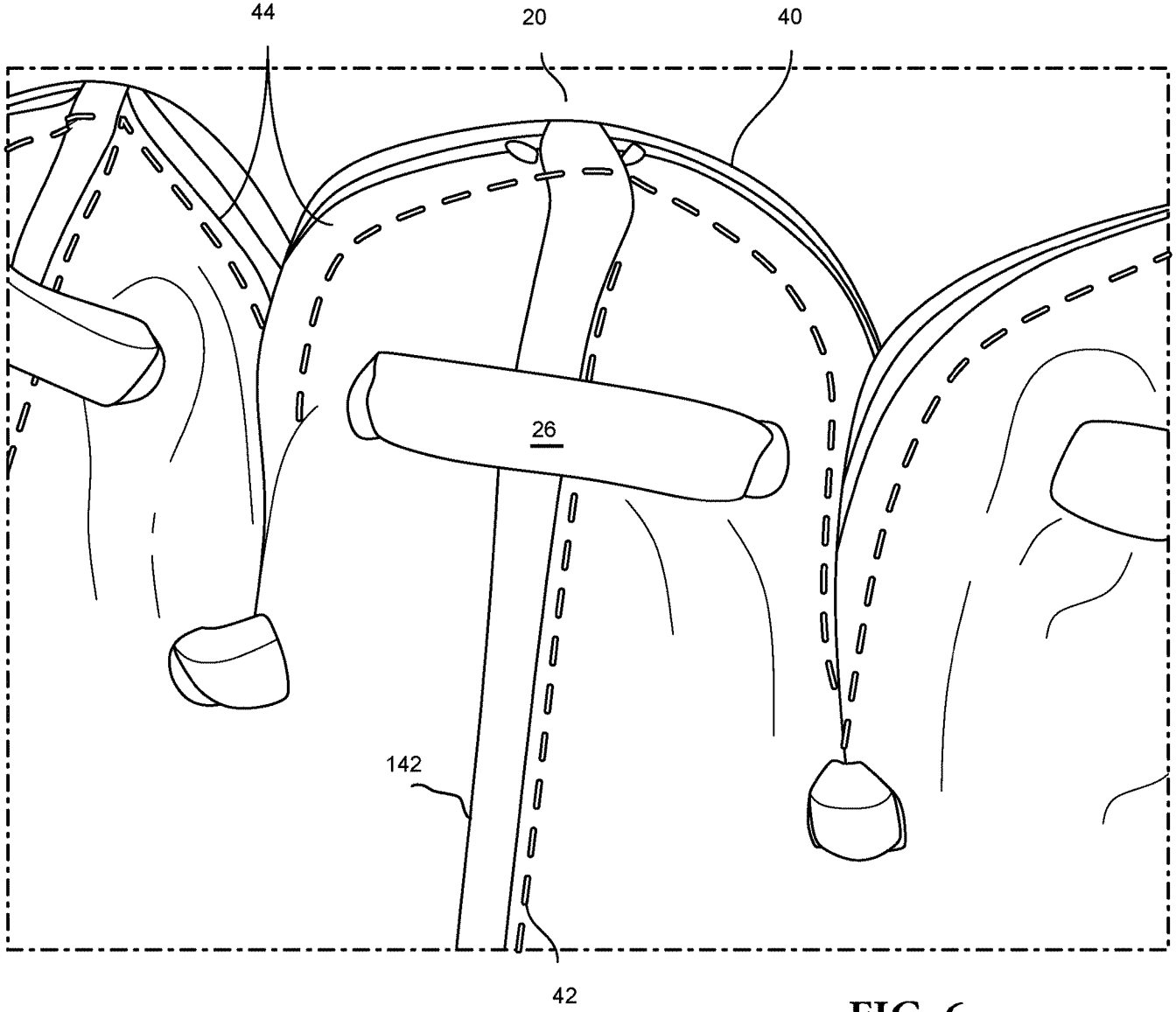
FIG. 6 illustrates a close-up view of the rear tips of fingers of a back view of an embodiment of the present invention.
Figure 7:
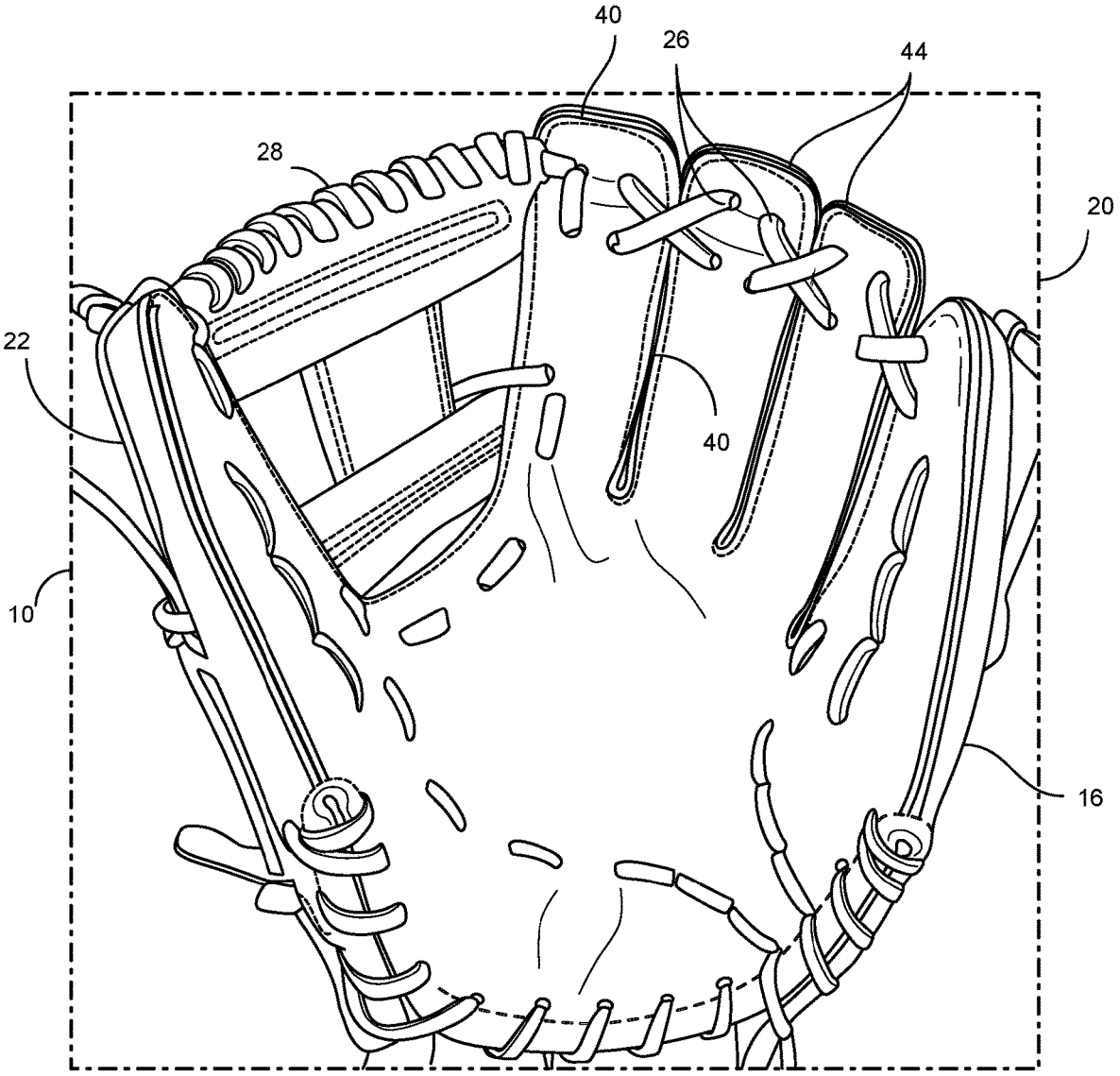
FIG. 7 illustrates a front view of a glove embodiment of the present invention.
Figure 8:
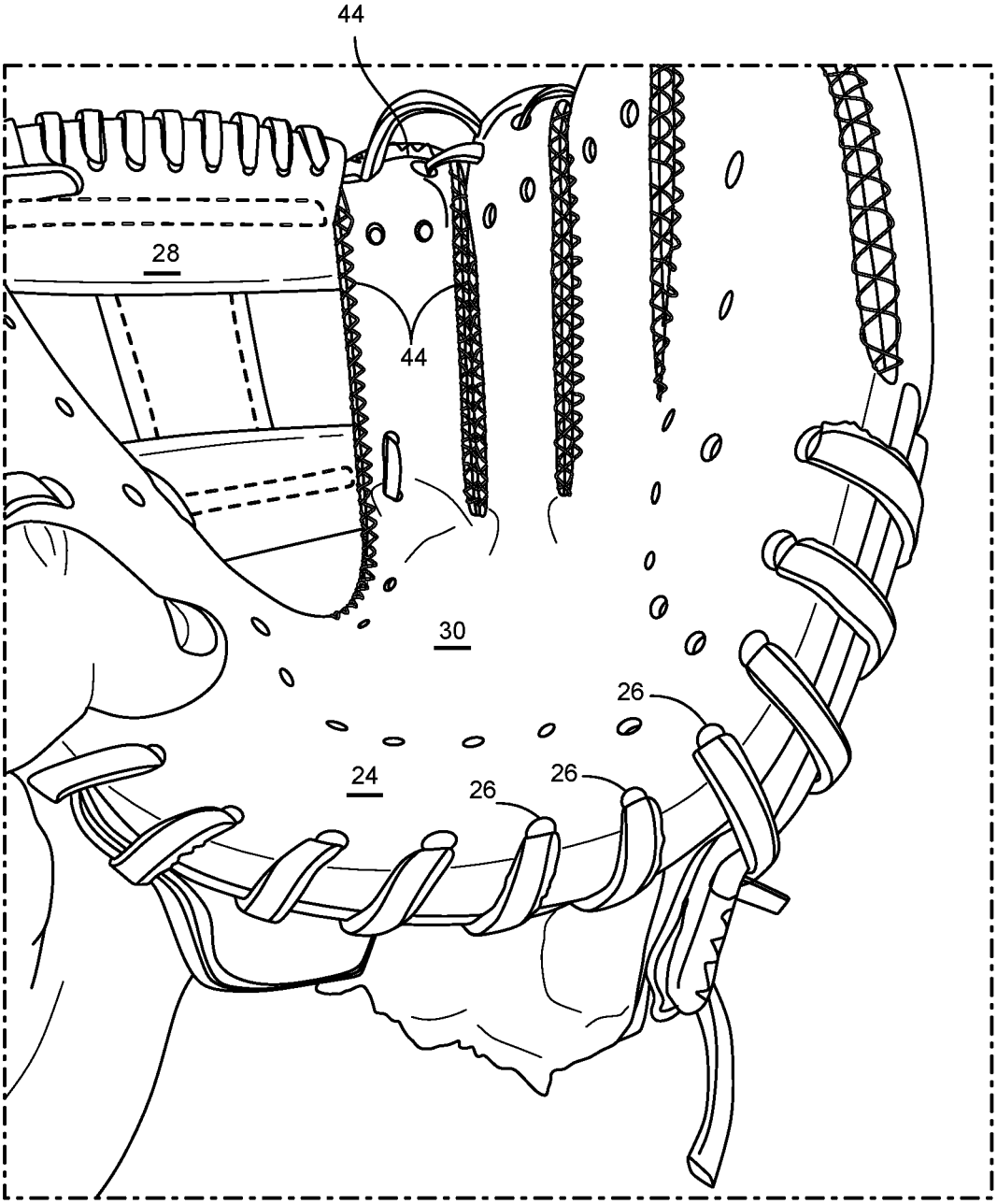
FIG. 8 illustrates a front view of the pocket of a glove embodiment of the present invention.
Figure 9:
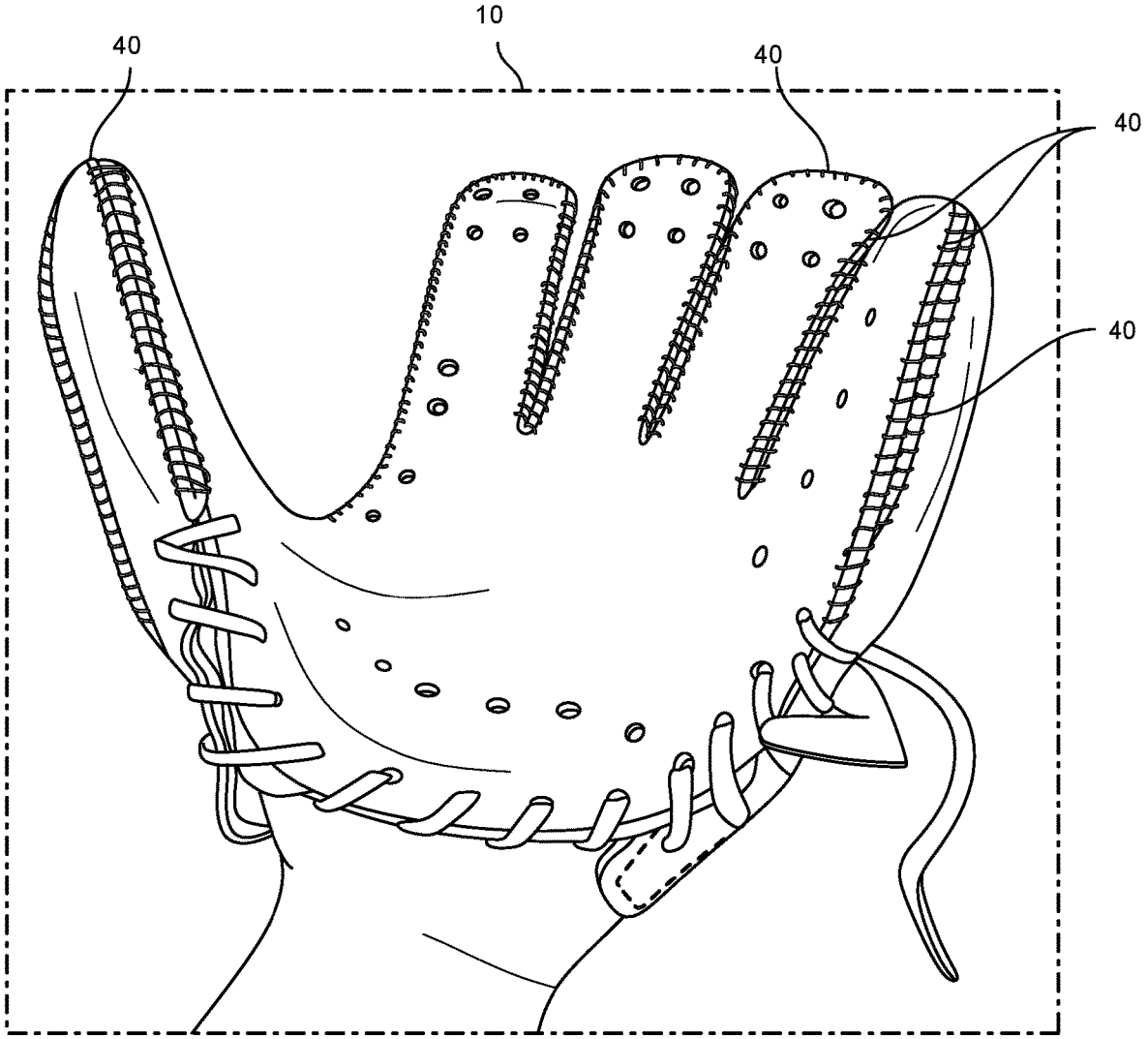
FIG. 9 illustrates a rear view of the heel and hand entry point of a glove embodiment of the present invention.
Figure 10:
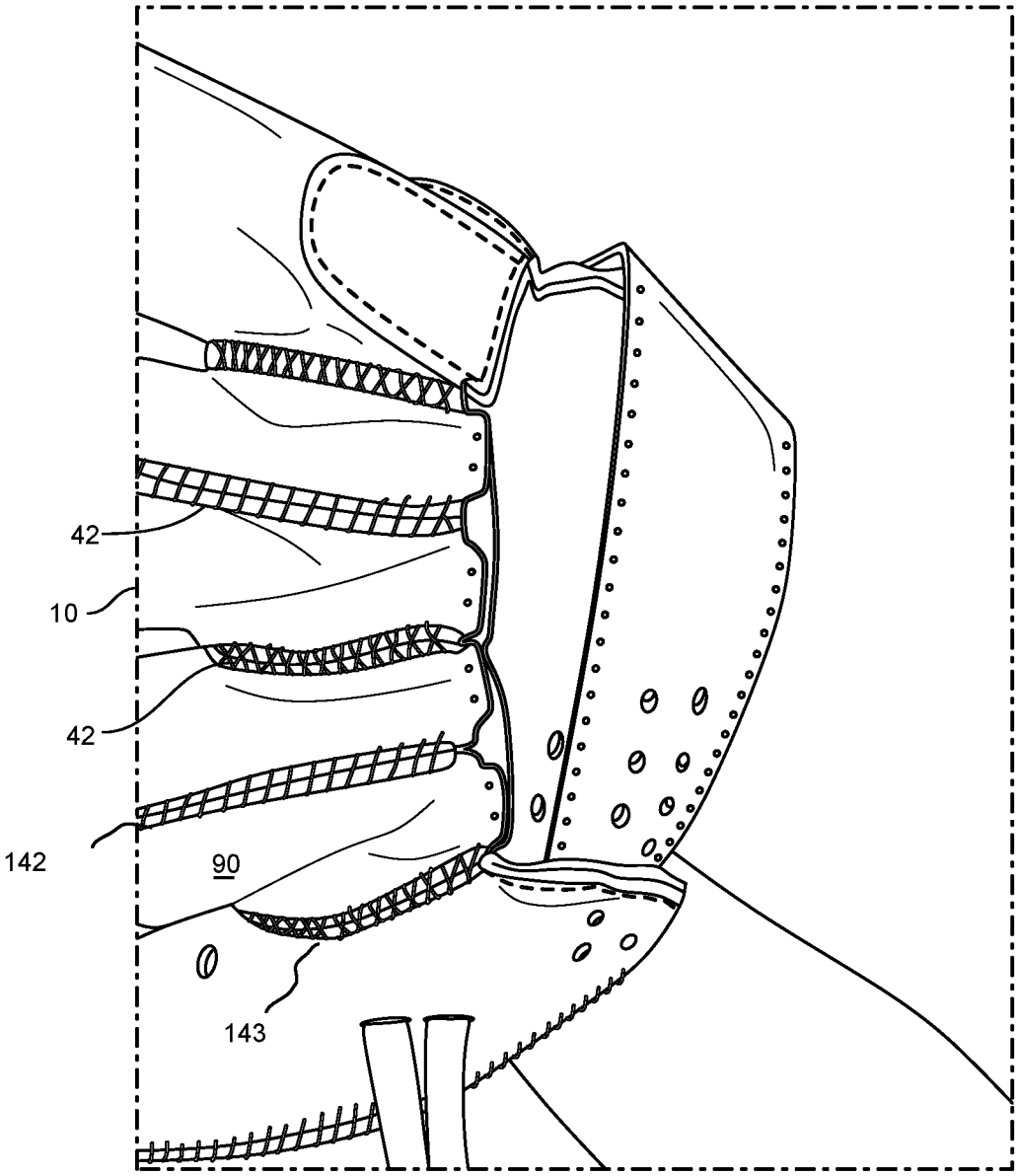
FIG. 10 illustrates a front view of a glove embodiment of the present invention.

Baseball gloves are normally stitched inside-out and then turned prior to lacing and forming. Gloves are sewn in the traditional way with welting piping & turning. In order to turn them without teating seams, when the leather is stitched together, welting is sewn in-between the leather components to make the seams stronger. This method of stitching requires a significant amount of skill and results in the need to perform significant shaping and forming after the glove is turned as a result of the leather being "disrupted" during turning. It also limits the type of leathers that are used in baseball gloves (normally softer chrome-tanned tanned leathers vs. more structured/stiffer veg-tanned leathers) or delicate/exotic leathers because they are not possible to turn or turning results in excessive creasing and damage to the leathers. Turning also hides the stitching or seams, which is common amongst glove-makers for many decades.

Baseball gloves can now be made without welting/piping and without turning so that edges and stitching are exposed and unique leathers can be employed. Some unique leather beyond bovine and kangaroo include, but are not limited to elephant, stingray, alligator/crocodile, snake, or any other material known in the art both organic and synthetic. As the glove does not have to be turned, the material does not need to withstand the turning process. Baseball gloves produced with outside stitching and without the need for turning, eliminate the need for welting and the difficulty associated with training operators to acquire the necessary skill to stitch baseball gloves. This method of construction reduces the amount of disruption/creasing to the leather and the amount of forming and shaping required. It also allows for use of leathers otherwise not possible in baseball gloves, such as veg-tanned, exotic and delicate leathers. This construction method results in unique opportunities in glove design, highlighted stitching that was previously not visible or highlighting edges created by exposing color on the back-side of leather or through edge painting. The edges may be painted to emphasize the look and to otherwise protect the exposed untanned internal leather.

As shown in FIGS. 1-10, a fielder's glove 10, as those familiar with gloves will recognize based on its size and shape, fielder's glove 10 is a standard fielders glove. Fielder's glove 10 has an outer shell 16 composed of a front surface, or palm 12, and a back surface 14. Outer shell 16 has an opening 25 at the lower portion of fielder's glove 10 to receive a hand. Front surface 12 and back surface 14 are joined together at various parts by stitch 44, to form a glove with exposed edges. Glove 10 is not turned and allows for the edges 40 of the glove to be exposed as they are when the die is cut to expose the interior material of the leather used. Outer shell 16 is shaped to form a pocket 30, fingers 20, and thumb 22. A web region 28 is located between finger portion 20 and thumb portion 22. Glove is made of a palm 12 as die cut that is sewn together with back 14 to form a shell. A liner 18 is set within the shell to provide for contact with the worn hand. Heel 24 of glove 10 is preferably laced with lacing 26, while the remainder of the perimeter of the shell is stitched with edges exposed. Hinge 32 is set between thumb and fingers aside the heel. Joints 42 similarly includes exposed edges of the leather material.

Joints in the martial are preferably formed by panels of material. Each panel preferably includes at least one finished surface. The surface may be finished by polishing, painting, glossing, tanning, etc, or as known in the art for ball gloves. Each panel also includes an edge that may or may not be painted or finished. When tanned, the edges may include the tanning stains. In the construction of a single glove, it may be preferable to include panels of alternating, or multitude of different species, such as a glove with a stingray panel, a snakeskin panel, a kangaroo panel, an elephant panel, or other substitutions to create a unique combination of panels of the back side of the glove. Each panel may be joined at a joint line. The panels may be joined on the back surface or back side of the glove to form the fingers. Each panel may form a half finger, or be shared as half of two adjacent fingers. Otherwise, the panels may span multiple fingers. In some embodiments, the back of the pinky finger may be made of a half finger panel along the outer edge, and a half of the panel shared with half of the adjoining ring finger. Similarly, the ring finger may include portions of two adjacent panels, with one panel shared with the pinky finger, and the other panel shared with the middle finger. The panel may be shaped in a U-shape, with the side edges formed with adjacent panels to form a joint line on the back, preferably along the center back, of the fingers. In a preferred embodiment, joint lines are set on the back sides of the pinky, ring, and middle fingers, wherein the panel of the forefinger extends to cover a portion of the middle finger on one side and joins with the webbing on the opposing edge. When a multitude leather sources are used, each finger, or portion of a finger, or adjacent fingers may include a separate species of leather.

Panels 90 form joint lines 142 between the finger. Additionally, joint lines 143 may appear between fingers. A further joint line 242 may appear on the thumb. The joint lines expose the edges of the panels, and may be stitched over, or a stitch may be set through the panels near the edge to join two adjacent panels and curve the edges outward to form the exposed joint lines.

Figure 11:
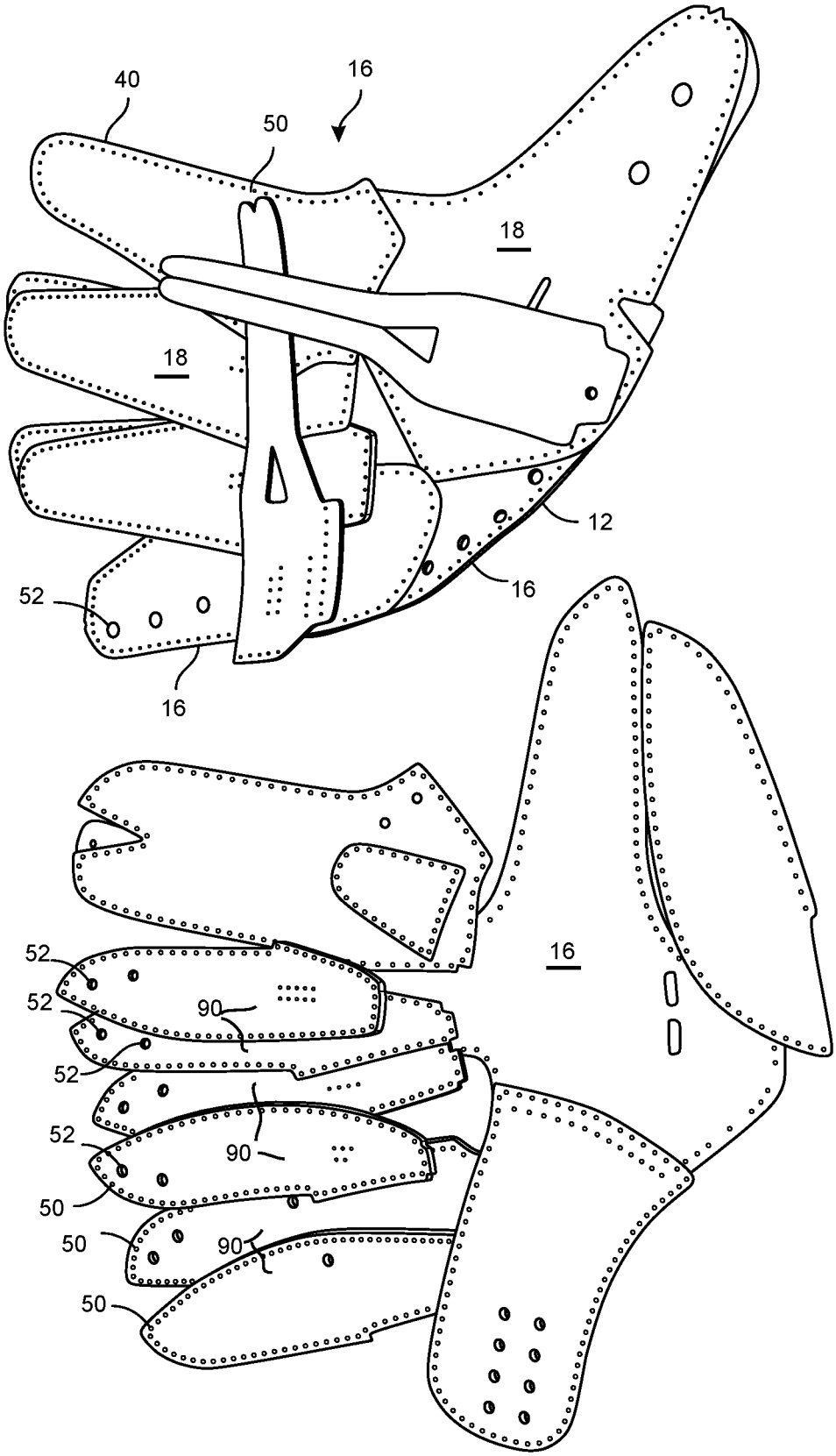
FIG. 11 illustrates a deconstructed view of parts of a glove embodiment of the present invention.

As shown in FIG. 11, the die cut pieces of the shell 16 and liner 18 include edges that have stitch holes 50 set therein and lace holes 52, each to receive a stitch or lace. No welts are required in the combination of the unturned glove, leading to a lower overall weight removed from the fulcrum (wrist) of the user, the lighter weight accommodates easier lifting and gripping/closing, of glove. No piping or other treatment is required to reinforce and/or provide ornamentation over the turned edges. Panels 90 may be used to form portions of the back surface of the fingers. Each panel 90 may include a half side of a finger, causing a joint line to appear on the back of the finger (see above 142) and optionally at the joining or between the finger (see 143 above). Otherwise, the panels may be shared between two adjacent fingers, with the first panel forming the outside of the pinky, the second panel forming the inside of the pinky and outside of the ring finger, the third panel forming the inside of the ring finger and outside of the middle finger, and the fourth panel forming the inside of the middle finger and the entre back portion of the pointer finger. Fingers. The panels may be joined on the back side with a an exposed joint, exposing the edge of the panel outzyard from the back surface of the glove.

Exposed edges manufacturing does not require glove turning which eliminates a step in the process and process, reduces the need for shaping and forming that normally takes place to offset the effects of turning. Eliminating the step of turning, eliminates the need for stitching leather welt or piping into the seams, which is normally needed to maintain the strength of the seams during turning. Not only does this eliminate the need of a raw material (welt or piping), stitching without welting requires less skill. This reduces the amount of training required, especially in the process of "closing" the glove where the palm is stitched to the back components.

The most difficult part of stitching a baseball glove is closing and the most difficult part of closing it stitching the crotch of the fingers. Stitching the crotches without welting allows for increasing the distance or space from one side of the crotch (one side of the finger) to the other (opposite side of the finger). This is not possible with welted gloves because the space between the fingers after turning becomes too great, risking a ball going through the glove (fingers) or requiring additional lacing to prevent that from happening. Stitching with exposed edges results in a greater surface area of leather being exposed to the ball and therefore allows for narrowing of the fingers or increasing the gap in the crotch to make it easier to stitch in the crotch area.

Stitching with welting or piping requires the gloves to be stitched inside-out and then turned, which makes it difficult for the stitching operator to detect stitching mistakes until after the glove is turned. When stitching mistakes are found at this point, the glove needs to be turned back and the correction made before re-turning again. With edge-exposed stitching, the stitching operator gets immediate feedback, can correct in the final form.

Stitching with exposed edges also allows the detection of "flanky" or poor-quality leather earlier on in the process, whereas with welt-stitching (lanky leather in the palm is often only identified after the glove is turned, again resulting in the glove having to be turned back and all the stitching taken out in order to replace the leather palm and stitch and turn again. This is both a cost and quality issue.

In terms of improvements to the final product, because turning is not required when exposing the edges, the gloves result in more consistent shape and size from one glove to the next. With welt stitching, the glove size and shape is more greatly impacted by the thickness/bulkiness of the welt after turning.

Further, by avoiding turning, the leather is disturbed significantly less, resulting in smoother leather with fewer creases. Leather components can be trimmed less, so less material is needed for seam margin as is required when the gloves are turned. This results in less bulky and more streamlined seams and gloves for any given size.

As the leather is disturbed significantly less, alternative leathers, typically not possible as a result of turning can be used. This applies to a wide range of exotic and specialty or delicate leathers as well as highly structured leathers that are very difficult to turn. These exotic materials may be used to comprise the entire palm to provide a one or two-toned theme wherein the palm and back are of different leather/material types.

There is also ornamental value in exposed edges that create a unique look with options to: (1) expose raw edges: (2) color or paint them as an added design feature; (3) highlight them with contrasting stitching that is also exposed; and (4) expose color that goes through the leather and is visible through the exposed edge that is normally not visible with welt stitching.

Exposed edge construction results in lighter weight gloves (which is considered a performance benefit) because welting is eliminated as well as less leather being used as a result of the ability to trim the components compared to a glove with welt construction for any given size glove.

Exposed edges on the ends of the fingers are less rigid and allow for easier "scooping" or fielding of ground balls compared to finger tips made with welt construction that are more rigid and can cause a ball to hit and bounce off the end of a finger more easily.

As for manufacture, there are a number of steps in the manufacture of gloves. Often these steps are sequential, meaning they have to be performed in a specific order. The prior art method of manufacture is amended as follows:

1. During stitching the liner and shell, welting is no longer required. No spine is needed in the stitches or joints. The shell can be constructed by joining the palm piece and back piece(s) without welts.
2. While malleting and aligning the pieces is a painstaking, and difficult process requiring strength, without turning the pieces are easier to align with proper die cuts.
3. Finally, the glove layoff is minimized as the leather can be set in an appropriate relative orientation when stitching and requires less forming/shaping. Similarly, the finally break-in process of beating the palm is significantly reduced as the shape of the die cut can include features that will manifest in three dimensional form (e.g. more palm leather near where the thumb meets fingers under the webbing) so the final product is manufactured in a broken-in form, as is known in the art.

Finally, there is another benefit to not turning the gloves when it comes to personalization (which has become a significant tread in recent years)—adding hard embellishments (e.g., metal) is not feasible when turning the gloves without causing damage to the leather. Stitching with exposed edges allows for easy addition of hard embellishments to be sewn on the glove as personalization or design. The hard embellishments may be added before or after die cutting, and prior to stitching.

I claim:

1. An exposed edge stitched ball glove comprising:

a) an outer shell, said outer shell comprising a front surface and a back surface shaped to form a finger portion having a plurality of fingers, a thumb portion, and a palm portion, said outer shell having an opening below said palm portion created by an unjoined region of said front surface and said back surface;

b) a web portion located between said finger portion and said thumb portion;

c) wherein the outer shell front surface and back surface are joined; and d) wherein each of the plurality of fingers comprises a plurality of panels, each of said plurality of panels comprising an outer surface and an edge surface;

e) wherein at last two of said plurality of panels are adjacent one another and are joined to form a joint line exposing an edge surface of each of the two adjacent plurality of panels; said joint line located either on the back surface along at least one of the plurality of fingers or between at least two adjacent fingers;

wherein the joint lines are exposed on an exterior surface of the ball glove.

2. The ball glove as set forth in claim 1 wherein said joint line is centered along a finger on the back surface of the finger.

3. The ball glove as set forth in claim 1 comprising joint lines on the back surface of each of a pinky finger, ring finger, and middle finger.

4. The ball glove as set forth in claim 3 wherein said joint line is absent between each of the plurality of fingers.

5. The ball glove as set forth in claim 1 wherein said joint line comprises stitching around the joint line.

6. The ball glove as set forth in claim 1 wherein said joint line is located on the back surface.

7. The ball glove as set forth in claim 1 wherein the joint line is located between two adjacent fingers.

8. The ball glove as set forth in claim 1, wherein the ball glove further comprises hard embellishments set on the exterior surface of at least one of said front surface and said back surface.

9. The ball glove as set forth in claim 1 wherein the back surface comprises organic material derived from a reptile and/or fish and/or mammal.

10. The ball glove as set forth in claim 9 wherein each of the plurality of panels comprise material derived from a separate creature.

11. The ball glove as set forth in claim 1 further comprising paint set over said edges along the exterior surface.

12. The ball glove as set forth in claim 1, wherein the exterior surface of comprises exposed stitching about the thumb portion.

13. The ball glove as set forth in claim 1, wherein the exterior surface of comprises exposed stitching about the palm portion.

14. A method of manufacturing a ball glove, said method comprising the steps of:

a. die-cutting exterior pieces, including the palm and back, the back including a plurality of panels, each of the plurality of panels including a back surface and an edge;

b. stitching of the exterior pieces to one another to form a shell, while exposing portions of the edges of the plurality of panels on the back along one or more fingers or between two adjacent fingers;

c. further stitching additional pieces to form a liner;

d. inserting the liner into the shell;

e. securing the liner to the shell with an adhesive;

f. binding the liner and shell together; and g. lacing the glove top fingers, and webbing.

15. The method of manufacturing a ball glove as set forth in claim 14 further comprising the step of hot stamping flat pieces after the step of die cutting.

16. The method of manufacturing a ball glove as set forth in claim 14 further comprising the step of embossing indicia on the flat pieces after the step of die cutting.

17. The method of manufacturing a ball glove as set forth in claim 14 further comprising the step of embellishing flat portions of the shell with a plate of metal after the step of die cutting prior to said step of stitching.

18. The method of manufacturing a ball glove as set forth in claim 14 further comprising the step of painting edges exposed after said step of stitching.

19. The method of manufacturing a ball glove as set forth in claim 14 wherein said step of stitching exposes portions of the edges of the plurality of panels along joint lines on the back along a pinkly pinky finger, a ring finger, and a middle finger.

20. The method of manufacturing a ball glove as set forth in claim 14 whereby said step of stitching causes one of the plurality of panels to form a half portion of each of two adjacent fingers.

21. The ball glove as set forth in claim 14 wherein said step of stitching comprises highlighting stitches with contrasting stitching that is exposed.

22. The ball glove as set forth in claim 1, wherein the exterior surface comprises exposed stitching about the finger portion.

23. The ball glove as set forth in claim 1, wherein the exterior surface comprises exposed stitching on the back surface of the finger portion.

24. An exposed edge stitched ball glove comprising:

a) an outer shell, said outer shell comprising a front surface and a back surface shaped to form a finger portion, a thumb portion, and a palm portion, said outer shell having an opening below said palm portion created by an unjoined region of said front surface and said back surface;

b) a web portion located between said finger portion and said thumb portion;

c) wherein the outer shell front surface and back surface are joined; and d) wherein the finger portion comprises a plurality of panels, each of said plurality of panels comprising an outer surface and an edge surface;

e) wherein at last two of said plurality of panels are adjacent one another and are joined to form a joint line exposing an edge surface of each of the two adjacent plurality of panels; said joint line located on the back surface;

wherein the joint lines are exposed on an exterior surface of the ball glove.

25. The ball glove as set forth in claim 24, wherein the exterior surface comprises exposed stitching on the back surface of the finger portion.

* * * * *